US008801227B1

(12) United States Patent
Loomis et al.

(10) Patent No.: US 8,801,227 B1
(45) Date of Patent: Aug. 12, 2014

(54) ILLUMINATED TREE TOP ORNAMENT APPARATUS

(76) Inventors: Jason A. Loomis, Boston, MA (US); Alexander Beale Loomis, New York, NY (US); Ryan Seyffert, Bellingham, MA (US)

( * ) Notice: Subject to any disclaimer, the term of this patent is extended or adjusted under 35 U.S.C. 154(b) by 0 days.

(21) Appl. No.: 12/231,342

(22) Filed: Sep. 2, 2008

Related U.S. Application Data

(60) Provisional application No. 61/967,026, filed on Sep. 1, 2007.

(51) Int. Cl.
*F21S 4/00* (2006.01)
*F21V 21/00* (2006.01)

(52) U.S. Cl.
USPC ..... 362/249.19; 362/396; 362/654; 362/807

(58) Field of Classification Search
USPC ..... 362/249.01–249.06, 396, 565–568, 362/653–654, 806–807, 249.19
See application file for complete search history.

(56) References Cited

U.S. PATENT DOCUMENTS 6,808,289 B2 * 10/2004 Reed ..... 362/198
7,419,277 B2 * 9/2008 Von Ronn et al. ..... 362/194

* cited by examiner

*Primary Examiner* — Jason Moon Han

(74) *Attorney, Agent, or Firm* — Craige Thompson; Thompson Patent Law Offices

(57) ABSTRACT

A tree top ornament with one or an array of lights, with an attachment mechanism for releasable attachment to the top branch or trunk of artificial and natural trees. The lights are connected to a sleeve designed to fit over the top vertical branch of the tree, but which is supported by a rigid conduit that clamps to the tree branch some distance below the top, so that the top of the branch does not itself bear any of the tree top ornament's weight. The user may selectively attach a variety of clear and semi clear acrylic or glass ornamental tree toppers for illumination by the lights.

4 Claims, 1 Drawing Sheet

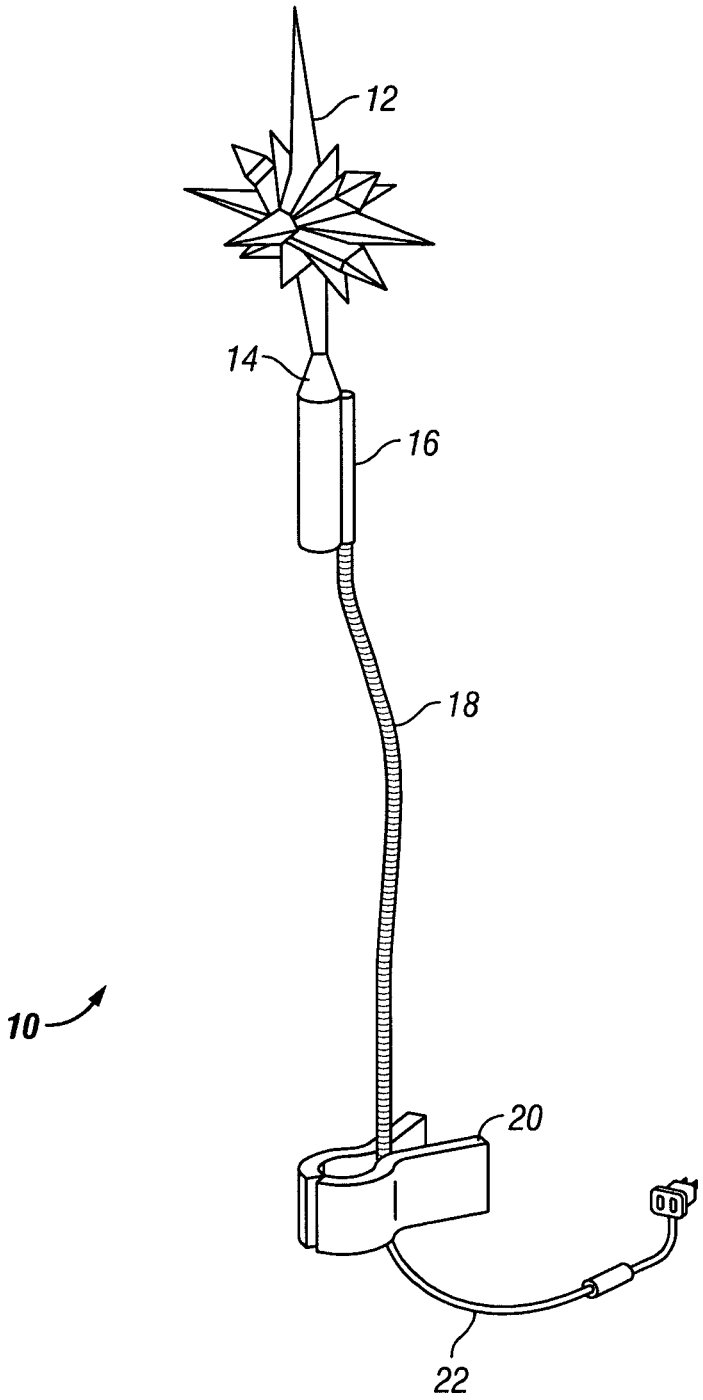
12
14
16
18
10
20
22

ILLUMINATED TREE TOP ORNAMENT APPARATUS

CROSS REFERENCE TO RELATED APPLICATIONS

The present application claims the benefit of the filing date of U.S. Provisional Patent Application Ser. No. 60/967,026, filed 1 Sep. 2007.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to tree decorations, ornaments, and illuminated light strings, and more particularly to an improved illuminated tree top ornament apparatus.

BACKGROUND INFORMATION AND DISCUSSION OF RELATED ART

U.S. Pat. No. 5,150,964 to Tsui discloses a structure of a joy light which is variable for flash function. The structure comprises a channel and frequency controller, a main conducting wire, a plurality of sockets and plugs of which the connecting channels are changeable, and a plurality of string lights.

U.S. Pat. No. 5,618,103 to Fussell describes motorized and lighted decorative ornaments. A rotative and lightable ornament apparatus has a miniature electrical input line in electrical communication with a circuit that is branched to lines leading to at least one miniature electrical motor and to at least one miniature electrical outlet for optional lighting and electrical rotation. The input line can be a Christmas tree light plug and the miniature outlet for optional lighting and electrical actuation can be a miniature light socket for a miniature light, flasher, or other miniature lamps. Circuitry for branching from the input line can include a plurality of electrically connected zener diodes to offset pulsating electrical effects of a flasher on the miniature motor.

U.S. Pat. No. 6,612,864 to Hsu discloses a lighting string with an extending structure, which includes an electrical wire with several bulb assemblies and some lighting units connected by extending wires. The lighting unit can emit light at a distance from the electrical wire of the lighting string to provide a special lighting effect. The lighting unit can also be connected with lighting fiber for a further extension of light.

U.S. Pat. No. 7,118,249 to Hsu, et al. describes a decorative illuminated article adapted for use with a lighting string includes a wiring assembly including a length of wire having a first end and a second end, the first end connected to a male insert, the second end connected to a lighting assembly, a hollow enclosure including a decorative element contained therein and a neck adapted to receive the lighting assembly, and a clip attached to the wire for receiving a light bulb from the lighting string.

The foregoing patents reflect the current state of the art of which the present inventors are aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination with other patents or non-patent references, the invention described and claimed herein.

BRIEF SUMMARY OF THE INVENTION

The illuminated tree top ornament apparatus of the present invention provides a tree top ornament with one or an array of LED or other lights, with an attachment mechanism for releasable attachment to the top branch or trunk of artificial and natural trees. The lights are connected to a sleeve designed to fit over the top vertical branch of the tree, but which is supported by a rigid or semirigid conduit that clamps to the tree branch some distance below the top, so that the weight of the ornament is borne by the portion of the tree branch adjacent the clamp, and the top of the branch does not itself bear any of the ornament's weight. The user may selectively attach a variety of clear and semi clear acrylic or glass ornamental tree toppers for illumination by the lights.

One problem with many natural and artificial trees is that the top of the tree often does not have the capacity to bear weight, making it difficult to place a tree top ornament. With the inventive design the user is able to clamp the apparatus onto the tree trunk some distance below the top of the tree (e.g., eighteen inches) at a point where the trunk is bigger, stronger, and more rigid.

It is therefore an object of the present invention to provide a new and improved lighting apparatus.

It is another object of the present invention to provide a new and improved illuminated tree top ornament.

A further object or feature of the present invention is a new and improved tree top ornament that can be used with either natural or artificial trees.

An even further object of the present invention is to provide a novel tree top ornament that permits placement of the ornament even on small or weak trees.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein:

FIG. 1 is a front elevation view of an illuminated tree top ornament apparatus of this invention.

DETAILED DESCRIPTION OF THE INVENTION

Referring to FIG. 1, there is illustrated therein a new and improved illuminated tree top ornament apparatus, generally denominated 10 herein. Apparatus 10 includes an ornament such as a star 12 attached to an LED or LED array 14, a sleeve 16 for placement on or over the end of a branch or tree trunk, a conduit or cable 18, a clamp 20 disposed on the opposite end of the cable from the LED light(s) and sleeve, and an electrical cord 22. The cable 18 is stiff (but is preferably at least mildly deformable to accommodate slight variations in trunk and branch shape), and preferably acts as a conduit for the cord 22 carrying the electricity to the LED light(s).

The adjustable cable/conduit 18 supports the sleeve 16, LED array 14 and ornament (e.g., star) 12. The sleeve 16 preferably includes a conical hollow 16*a* on the bottom which is designed to fit over the top vertical branch of the tree, but since it is supported by the rigid or semirigid conduit 18 that clamps to the tree branch some distance below the top, the top of the branch does not itself bear any of the tree top ornament's weight.

The LED(s) or other lights may be clear or of any color, or of variable color, to give the desired effect to the illuminated ornament, which may be constructed of clear or colored acrylic or other suitable material. The sleeve, conduit, clamp, cord, and other visible components are preferably of a construction and color to blend with the tree.

A variation of the inventive apparatus provides a table top (or mantle, windowsill, or other surface) apparatus that illuminates the acrylic objects (e.g., star, angel). This table top LED array may be made in two versions and has two functions.

A first version is battery operated and may work on a 24 hour timer that turns on for 5 hours (or more or less) each day automatically. A second version utilizes a rechargeable battery that rests in a home position on a charging plate, much like a wireless home phone, and can then be put on a dinner table or in a windowsill when desired. This version may also work on a 24 hour timer and turn on for a selected period each day automatically.

A first function of the inventive table top apparatus is the illumination of the acrylic pieces. A second function is that the apparatus can be used to illuminate a standard pillar candle (made of real wax). This allows the user to create a beautiful light effect in the candle material, but with the use of real candles that are actually lit.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. An illuminated tree top ornament apparatus comprising:

an ornament illuminated by at least one light;

a sleeve having a hollow bottom portion connected to said at least one light, said hollow bottom portion adapted to fit over a top vertical branch of a tree;

a rigid conduit connected to said sleeve; and a clamp connected to said rigid conduit, wherein when said clamp is clamped to the top vertical branch some distance below a top of the top vertical branch, the top of the top vertical branch fits within said hollow bottom portion and does not bear any of the weight of said ornament, said light, and said sleeve.

2. The illuminated tree top ornament of claim 1 wherein said at least one light comprises an LED light.

3. The illuminated tree top ornament of claim 1 wherein said ornament comprises a clear acrylic ornament.

4. The illuminated tree top ornament of claim 1 wherein said rigid conduit includes an electrical cord for carrying power to said at least one light.

* * * * *